US005487363A

United States Patent [19]

Batzill et al.

[11] Patent Number: 5,487,363

[45] Date of Patent: Jan. 30, 1996

[54] INTERNAL-COMBUSTION ENGINE COMPRISING TWO CYLINDER BANKS

[75] Inventors: Manfred Batzill, Neuhausen; Hans-Joachim Esch, Heimsheim; Hans Mezger, Freiberg; Winfried Distelrath, Stuttgart; Albrecht Reustle, Walheim, all of Germany

[73] Assignee: Dr. Ing. h.c.F. Porsche AG, Weissach, Germany

[21] Appl. No.: 266,860

[22] Filed: Jul. 5, 1994

[30] Foreign Application Priority Data

Jul. 2, 1993 [DE] Germany ..... 43 22 030.4

[51] Int. Cl.[6] ..... F02B 75/18

[52] U.S. Cl. ..... 123/41.74; 123/41.33; 123/55.2; 123/196 AB

[58] Field of Search ..... 123/41.33, 41.74, 123/55.2, 55.5, 196 AB

[56] References Cited

U.S. PATENT DOCUMENTS

| | | | |
|---|---|---|---|
| 1,958,156 | 5/1934 | Whelan | 123/41.28 |
| 2,111,828 | 3/1938 | Weaver | 184/6 |
| 2,914,045 | 11/1959 | Hill | 123/41.72 |
| 5,058,535 | 10/1991 | Wilinson | 123/41.28 |

FOREIGN PATENT DOCUMENTS

| | | |
|---|---|---|
| 738122 | 12/1932 | France . |
| 204339 | 4/1939 | Switzerland . |
| 444888 | 3/1936 | United Kingdom . |

OTHER PUBLICATIONS

SAE Technical Paper Series, Paper No. 890471, 1989.

*Primary Examiner*—Noah P. Kamen

*Attorney, Agent, or Firm*—Evenson McKeown Edwards & Lenahan

[57] ABSTRACT

For avoiding exterior, cooling-water-carrying ducts, an internal-combustion engine comprising two mutually opposite cylinder banks has integrated ducts for the feeding and removal of the cooling water to the cooling jackets and the cylinder heads.

8 Claims, 2 Drawing Sheets

INTERNAL-COMBUSTION ENGINE COMPRISING TWO CYLINDER BANKS

This invention relates to an internal-combustion engine comprising two cylinder banks, a cooling water pump arranged on an end face of one cylinder bank, a connecting duct leading below a longitudinal axis of an engine crankshaft from the pump to the other cylinder bank, and cooling water jackets and cylinder heads through which the cooling water flows in a transverse manner.

SAE Technical Paper No. 890471, 1989, discloses an internal-combustion engine of the above-mentioned type whose water pump is flanged to the cylinder block of one cylinder bank in a manner that is offset on the face radially to the crankshaft. This pump delivers cooling water into the opposite cylinder bank by way of a connecting duct cast in below the crankshaft into one of the crankshaft bearings.

By means of a horizontal wall, the cooling jackets of the crankcase halves, which are constructed in an open-deck construction, are divided into halves so that the cooling water first flows through the half situated on the bottom, then flows in a transverse flow in a U-shaped manner through the cylinder heads, and then flows through the half of the cooling jackets situated on top.

Finally, the cooling water is guided by way of one flow-off piece of the cylinder banks respectively into a separate collector which is connected to the radiator of the internal-combustion engine.

From U.S. Pat. No. 2,914,045, a two-bank internal-combustion engine with a horizontal cylinder arrangement is known whose crankcase is cast on in one piece and has a U-shaped crank space which is open toward the bottom. For reinforcing the opening of the crankcase situated on the bottom and for guiding the cooling water, water-carrying longitudinal ducts are cast in adjacent to this opening which extend in the longitudinal direction of the crankshaft. A water pump case is flanged to the face of the crankcase. An impeller, which is arranged on the crankshaft, rotates in the pump case and guides cooling water into the two longitudinal ducts. Transversely extending, inserted pipes lead into these longitudinal ducts and guide the whole cooling water flow to the cylinder heads, through which a transverse flow travels in the upward direction, and then guide the heated water by way of external pipes to a radiator. The flow does not lead through the cooling water jacket of the cylinders, and this cooling water jacket cools by means of a thermosiphon effect.

It is an object of the invention to improve an internal-combustion engine comprising two cylinder banks in such a manner that the cooling water flow is guided so that it is largely integrated in housing parts of the internal-combustion engine and an effective cooling is achieved at the same time.

This object is achieved according to the invention by providing an engine of the above-noted type with two mutually opposite cylinder banks with integrated ducts for the feeding and removal of cooling water to the cooling jackets and the cylinder heads.

In especially preferred embodiments, an internal-combustion engine is provided comprising an engine crankshaft having a crankshaft axis, first and second cylinder banks with cylinder blocks for cylinders housing pistons drivingly connected to the crankshaft, said first and second cylinder banks being disposed at opposite lateral sides of the crankshaft axis; a first cylinder head connected to the first cylinder block along a first separating plane; a second cylinder head connected to the second cylinder block along a second separating plane; a cooling water pump arranged on an end face of the first cylinder block; a connecting duct extending between the pump and the second cylinder bank, said connecting duct extending underneath the crankshaft axis; cooling water jackets in the cylinder blocks, and a cooling opening in the cylinder heads through which cooling water from the pump flows in a transverse manner; a cooling water collector arranged above the crankshaft axis for collecting water flowing from the cylinder banks; a feeding duct for cooling water arranged in each respective lower wall of the first and second cylinder banks adjacent the respective first and second separating planes and extending below and parallel to the crankshaft axis; and a discharge duct for cooling water arranged in each respective upper wall of the first and second cylinder banks adjacent the respective first and second separating planes and extending parallel to the crankshaft axis.

In the case of a two-bank internal-combustion engine according to the invention, feeding and discharge ducts for cooling water are provided extending, respectively, below and above the crankshaft longitudinal axis and parallel thereto adjacent to separating planes situated between the cylinder heads and the cylinder blocks. The feeding and discharge ducts are arranged in a lower and upper wall of the cylinder bank so that separate lines are not necessary because of the arrangement integrated into the walls. Thus, the connected expenditures with respect to the mounting, the manufacturing and the number of components will also not be required. The arrangement of the feeding and discharge ducts adjacent to the separating plane ensures an effective cooling because the cooling water is fed in direct proximity of the combustion space, flows through the cooling jacket and the cylinder head and is then discharged along the shortest and most direct path.

The discharge of the cooling water of both cylinder banks can advantageously take place by way of a single separate pipe arranged between a water/air heat exchanger and the internal-combustion engine if the cooling water flows of the discharge ducts are connected with one another by way of a transverse duct arranged in the upper wall of the cylinder blocks.

If this transverse duct is arranged adjacent to the face of the internal-combustion engine carrying the cooling water pump, the cooling water, for the purpose of an optimal cooling, is first guided from this face along the feeding ducts in the direction of the opposite face and back from there to the first face.

The arrangement of an inlet opening of one of the feeding ducts in an indentation accommodating the cooling water pump makes it possible for this one cylinder bank to have a direct water inlet from the pump into this duct without any additional connections.

The arrangement of a section of the connecting duct between the cooling water pump and the other cylinder bank in an oil pan of the internal-combustion engine additionally utilizes the space which exists and is required there and avoids a complicated and high-expenditure connection. Additional advantages are that this section may be constructed as a heat exchanger pipe which is used for the heating and cooling of the lubricating oil situated in the oil pan and, for this purpose, has cooling ribs on its exterior surface. A separate oil cooler is therefore not necessary. In addition, in the case of a vertically divided crankcase of the internal-combustion engine, a water penetration by way of the separating plane of the crankcase is avoided because of the use of such a pipe.

By means of the arrangement of the feeding ducts adjacent to the separating planes between the cylinder block and the cylinder heads, it is possible to apportion the cooling water flow to the cooling jacket or the cylinder head by means of first or second connection which have a simple and short design and a calibrated passage cross-section.

In a particularly simple manner, the ducts carrying the cooling water flow can be integrated into the housing parts of the internal-combustion engine if these are cast in directly during the manufacturing. As a modification, pipes may be cast in.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
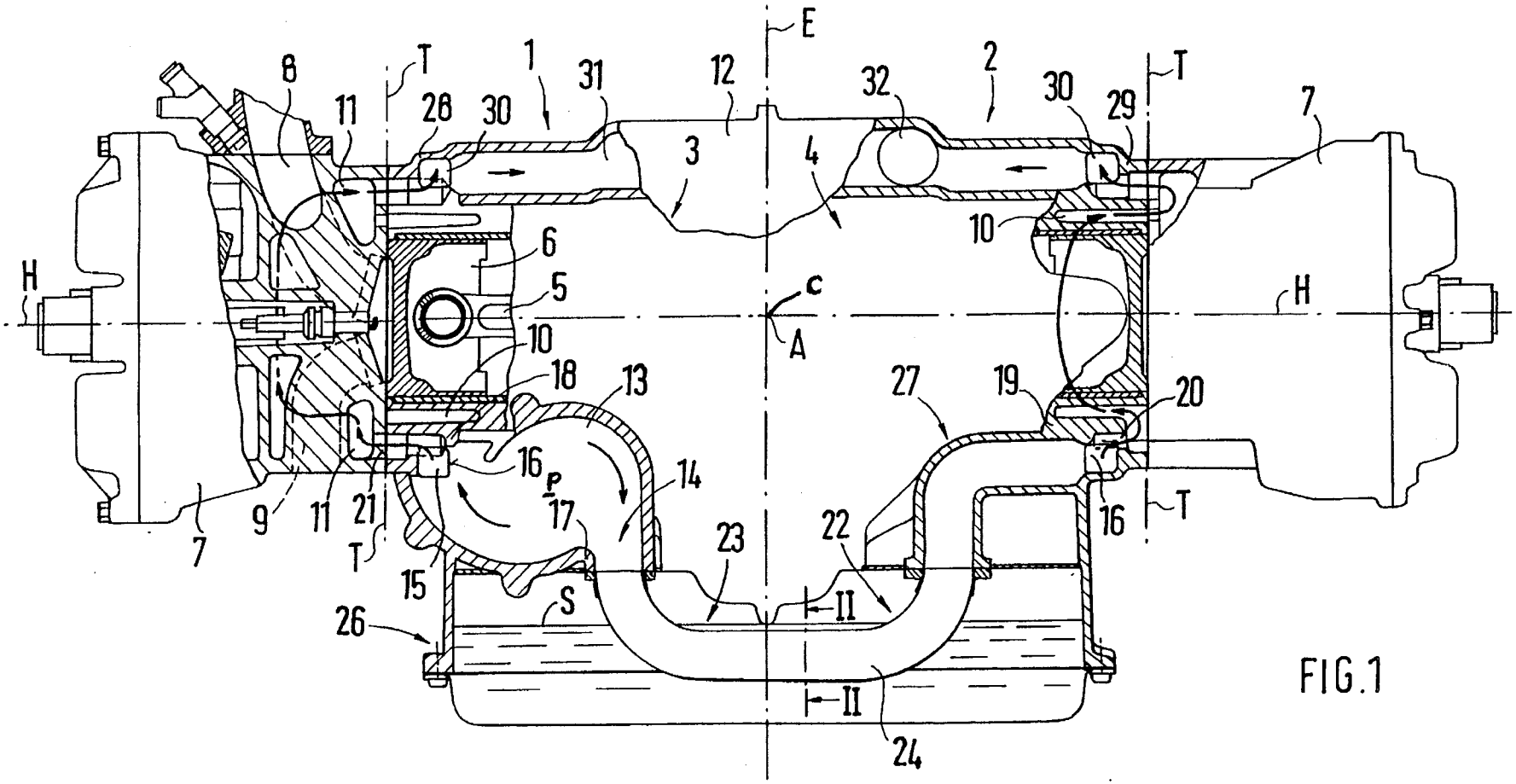
FIG. 1 is a schematic part cross-sectional view of an internal-combustion engine directly adjacent to one of its end faces constructed according to a preferred embodiment of the invention.
Figure 2:
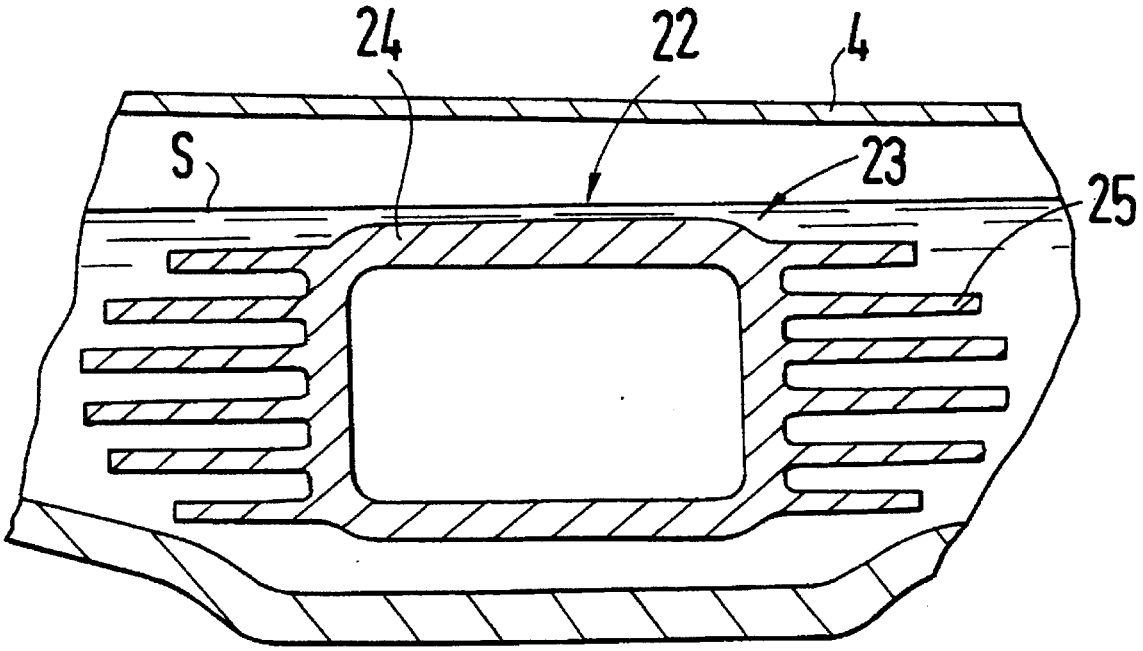
FIG. 2 is a sectional view along Line II—II according to FIG. 1.

An internal-combustion engine having two cylinder banks and a V-angle of 180° has a crankcase which is separated vertically along a separating plane E—E and has two halves 1, 2 which reach around cylinder blocks 3, 4. A longitudinal axis A, which is at the same time the axis of rotation of a crankshaft C, extends in this plane E—E. The crankshaft is connected by way of connecting rods 5 with pistons 6 which move in a horizontal plane H—H. A cylinder head 7 is assigned to each cylinder bank and is placed in a respective separating plane T—T on a crankshaft half 1, 2. The heads 7 each have inlet and outlet ports 8 and 9 which are controlled by charge cycle valves which are not shown. The cylinders of each cylinder bank have cooling water jackets 10, and the heads 7 have cooling water ducts 11.

At one engine end face 12, an indentation 13 for accommodating a cooling water pump which is schematically shown at P is arranged on one cylinder block 3. By way of two flow-off openings 14, this cooling water pump delivers cooling water to the cylinder banks 1, 2, in which case one of these flow-off openings 14 is constructed as an inlet opening 15 into a feeding duct 16 and the other is constructed in a downwardly directed flow-off flange 17.

Both cylinder banks have, adjacent to the separating planes T—T, extending below and in parallel to the longitudinal axis A, feeding ducts 16 which are arranged in a lower wall 18, 19. By way of calibrated first connections provided with a defined cross-section, these ducts 16 are connected with the cooling water jackets 10 and by way of second connections 21, are connected with the ducts 11.

The feeding duct 16 of the cylinder bank which is spaced away from the cooling water pump is connected by means of a connecting duct 22 to the flow-off flange 17. A section 23 of this duct 22 is constructed as a heat exchanger pipe 24 and extends in an oil pan 26 of the internal-combustion engine while being equipped with cooling ribs 25 on its exterior shell. The tube 24 bridges the separating plane E—E and is connected to another section 27 of the connecting duct 22 which is constructed in the lower wall 19.

Extending in parallel to the longitudinal axis A, corresponding discharge ducts 30 are arranged in the upper walls 28, 29 of the crankcase halves 1, 2, which discharge ducts 30 are connected with the cooling jackets 10 and the ducts 11 of the cylinder heads 7. Adjacent to the engine end face 12, a collector, which is constructed as a transverse duct 31, is arranged in the walls 28, 29 and is connected by way of a flow-off piece 32 with a water/air heat exchanger which is not shown.

The feeding and discharge ducts 16 and 30, the transverse duct 31 and the section 27 of the connecting duct 22 are cast into the walls 18, 19, 28, 29.

During the operation of the internal-combustion engine, the cooling water pump delivers along the drawn direction arrows a cooling water flow by way of the inlet opening 15 or the connection duct 22 into the feeding ducts 16, from which the water flow, from the direction of the face 12, is distributed along the axis A according to the cross-sections of the connections 20 and 21 to the cooling jackets 10 and the cylinder heads 7. The transverse flow flows through the heads 7, and the heated partial flows are fed to the discharge ducts 30. In these discharge ducts 30, the water flows back to the transverse duct 31 situated adjacent to the end face 12 and to its flow-off piece 32.

In the warm-up phase after the cold start, the water, which flows through the heat exchanger pipe 24, heats up the oil sump outlined by an oil level line S, so that the internal-combustion engine reaches its operating temperature faster, and therefore its harmful substance emission is reduced. Because of the larger heat storage capacity of water in comparison to oil, the ribbing is disposed in the oil in a horizontal position for achieving a heat transfer that is as good as possible. During the continuous operation of the internal-combustion engine, the oil reaches a higher temperature than the water flowing through the pipe 24, so that the oil is cooled.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An internal-combustion engine comprising:

an engine crankshaft having a crankshaft axis;

first and second cylinder banks with cylinder blocks for cylinders housing pistons drivingly connected to the crankshaft, said first and second cylinder banks being disposed at opposite lateral sides of the crankshaft axis;

a first cylinder head connected to the first cylinder block along a first separating plane;

a second cylinder head connected to the second cylinder block along a second separating plane;

a cooling water pump arranged on an end face of the first cylinder block;

a connecting duct extending between the pump and the second cylinder bank, said connecting duct extending underneath the crankshaft axis;

cooling water jackets in the cylinder blocks, and a cooling opening in the cylinder heads through which cooling water from the pump flows in a transverse manner;

a cooling water collector arranged above the crankshaft axis for collecting water flowing from the cylinder banks;

a feeding duct for cooling water arranged in each respective lower wall of the first and second cylinder banks adjacent the respective first and second separating planes and extending below and parallel to the crankshaft axis, said feeding ducts extending from respective lower walls of the cylinder banks through the associated separating plane into the associated cylinder head and then communicating with said cooling water jackets; and a discharge duct for cooling water arranged in each respective upper wall of the first and second cylinder banks adjacent the respective first and second separating planes and extending parallel to the crankshaft axis.

2. An internal-combustion engine according to claim 1, wherein the discharge ducts are connected with one another by way of the collector which is arranged in the upper walls adjacent to an end face of the internal-combustion engine and is constructed as a transverse duct.

3. An internal-combustion engine according to claim 2, wherein the feeding ducts, the discharge ducts, the transverse duct and in sections the connecting duct are cast into the cylinder block walls.

4. An internal-combustion engine according to claim 2, wherein the transverse duct is arranged adjacent to the end face carrying the cooling water pump.

5. An internal-combustion engine according to claim 1, wherein an inlet opening of one of the feeding ducts is arranged in an indentation of the first cylinder block which accommodates the cooling water pump.

6. An internal-combustion engine according to claim 1, wherein the connecting duct is arranged extending in sections in an oil pan of the internal-combustion engine.

7. An internal-combustion engine according to claim 6, wherein a section of the connecting duct extending in the oil pan is constructed as a heat exchanger pipe which carries cooling ribs on its exterior shell.

8. An internal-combustion engine according to claim 1, wherein each feeding duct is provided with first and second connections and is connected with the cooling jacket and the cylinder head.

* * * * *